US008896636B2

(12) United States Patent
Lee et al.

(10) Patent No.: US 8,896,636 B2
(45) Date of Patent: Nov. 25, 2014

(54) TEST DEVICE FOR DISPLAY PANEL AND METHOD OF TESTING THE SAME

(75) Inventors: Jeong-Yeol Lee, Yongin (KR); Sun-Youl Lee, Yongin (KR)

(73) Assignee: Samsung Display Co., Ltd., Yongin-si (KR)

( * ) Notice: Subject to any disclaimer, the term of this patent is extended or adjusted under 35 U.S.C. 154(b) by 916 days.

(21) Appl. No.: 12/871,827

(22) Filed: Aug. 30, 2010

(65) Prior Publication Data

US 2011/0221784 A1 Sep. 15, 2011

(30) Foreign Application Priority Data

Mar. 15, 2010 (KR) ..... 10-2010-0022974

(51) Int. Cl.
*G09G 3/32* (2006.01)

(52) U.S. Cl.
CPC ..... *G09G 3/3233* (2013.01); *G09G 2320/0626* (2013.01); *G09G 2360/145* (2013.01)
USPC ..... 345/690; 345/76; 428/690; 257/48

(58) Field of Classification Search
CPC ..... G09G 3/3233; G09G 2320/0626; G09G 2360/145
USPC ..... 345/690, 76; 428/690; 257/48
See application file for complete search history.

(56) References Cited

U.S. PATENT DOCUMENTS

| | | | | |
|---|---|---|---|---|
| 6,414,661 | B1 * | 7/2002 | Shen et al. | 345/82 |
| 2003/0063081 | A1 * | 4/2003 | Kimura et al. | 345/211 |
| 2006/0044227 | A1 * | 3/2006 | Hadcock | 345/76 |

FOREIGN PATENT DOCUMENTS

| | | | |
|---|---|---|---|
| KR | 10-2001-0059194 | | 7/2001 |
| KR | 10-2003-0044661 | | 6/2003 |
| KR | 10-2005-0104064 | A | 11/2005 |
| KR | 10-2008-0006116 | A | 1/2008 |
| KR | 10-2008-0061321 | A | 7/2008 |
| KR | 10-2008-0090923 | | 10/2008 |
| KR | 10-2009-0056290 | | 6/2009 |

* cited by examiner

*Primary Examiner* — Ariel Balaoing
(74) *Attorney, Agent, or Firm* — Christie, Parker & Hale, LLP

(57) ABSTRACT

A test device for a display panel and a method of testing the same are provided. The test device for a display panel includes a luminance measurement unit that measures a luminance value of a display panel including a plurality of pixels, and a controller that determines a voltage value of a data signal corresponding to a target luminance value, receives a measured luminance value of a pixel to which the data signal is supplied from the luminance measurement unit from among the plurality of pixels, compares the measured luminance value and the target luminance value, and outputs a control signal that changes a first power source voltage value supplied from a power source voltage supply unit to the pixel until the measured luminance value does not coincide with the target luminance value.

17 Claims, 6 Drawing Sheets

TEST DEVICE FOR DISPLAY PANEL AND METHOD OF TESTING THE SAME

CROSS-REFERENCE TO RELATED APPLICATION

This application claims priority to and the benefit of Korean Patent Application No. 10-2010-0022974 filed in the Korean Intellectual Property Office on Mar. 15, 2010, the entire content of which is incorporated herein by reference.

BACKGROUND

1. Field

The present invention relates to a test device for a display panel and a method of testing a display panel.

2. Description of Related Art

Currently, various flat panel displays that can reduce weight and volume, which are drawbacks of a cathode ray tube, are being developed. Flat panel displays include liquid crystal displays (LCDs), field emission displays (FEDs), plasma display panels (PDPs), organic light emitting diode (OLED) displays, and the like.

OLED displays display images using OLEDs that generate light by a recombination of electrons and holes, have a fast response speed, are driven with low power consumption, and have excellent luminous efficiency, luminance, and viewing angle.

In general, OLED displays are classified into a passive matrix type OLED (PMOLED) and an active matrix type OLED (AMOLED), according to a method of driving OLEDs.

The PMOLED display uses orthogonal positive electrodes and negative electrodes and a driving method of selecting negative lines and positive lines. The AMOLED display uses a driving method of sustaining a data voltage by forming a thin film transistor and a capacitor in each pixel and storing the data voltage in the capacitor. The PMOLED display has a simple structure and is relatively inexpensive, but is generally difficult to manufacture a panel of large size or high precision. In contrast, the AMOLED display can include a panel having large size or high precision, but a method of controlling the AMOLED display is technically difficult to implement. Furthermore, an AMOLED display is relatively expensive to manufacture.

In consideration of resolution, contrast, and operation speed, an AMOLED display that selectively turns on each pixel is primarily used.

A pixel of the AMOLED display includes an OLED, a driving transistor that controls an amount of current that is supplied to the OLED, and a switching transistor that supplies a data signal, which controls light emitted from the OLED, to the driving transistor.

In regards to a driving transistor of the pixels of the AMOLED display, a difference occurs in current flowing to the OLEDs due to a variation of threshold voltages of the driving transistors or a variation of a power source voltage that is supplied to each pixel, and thus a variation occurs in luminance of the OLEDs.

For example, currently, as the size of the display panel of the OLED display increases, the power consumption increases, and it is difficult to manufacture a screen of high image quality and high precision that also emits light with uniform luminance.

To meet needs for improving quality of the display panel of the display device, research regarding a device and method for measuring, testing, diagnosing, and checking for improving image quality and power consumption of the display panel is ongoing.

The above information disclosed in this Background section is only for enhancement of understanding of the background of the invention, and therefore it may contain information that does not form the prior art that is already known to a person of ordinary skill in the art.

SUMMARY

According to an aspect of embodiments according to the present invention, there is provided a test device for reducing power consumption (e.g., reducing power consumption to an optimum level) by controlling a driving voltage of an element in a display panel in which an increase in an area of a screen, a high image quality, and a high luminance are required.

According to an aspect of embodiments according to the present invention, there is provided a testing method for automatically setting and controlling a driving voltage of a display panel in accordance with either internal and external environment changes of the display panel or an encountered problem to reduce defects such as stain defects of the screen, and to have a high picture quality.

The technical aspects of the present invention are not limited to the above-described technical aspects, and other technical aspects will be understood by those skilled in the art from the following description. In order to achieve the foregoing and/or other aspects of embodiments according to the present invention, according to one embodiment of the present invention, there is provided a test device for a display panel including a luminance measurement unit configured to measure a luminance value of a display panel including a plurality of pixels, and a controller configured to determine a voltage value of a data signal corresponding to a target luminance value, to receive a measured luminance value of a pixel to which the data signal is supplied from the luminance measurement unit from among the plurality of pixels, to compare the measured luminance value and the target luminance value, and to output a control signal that changes a first power source voltage value supplied from a power source voltage supply unit to the pixel until the measured luminance value does not coincide with the target luminance value.

In an exemplary embodiment of the present invention, the target luminance value is specified, although the invention is not limited thereto, and the measurement luminance value may be compared with a target luminance value in which a predetermined margin is considered as the target luminance value.

The target luminance value in which a predetermined margin is considered is not particularly limited, and even if luminance of the pixel is measured as a value higher than an intended target luminance by a predetermined margin, it may be recognized that light is emitted at a level of target luminance.

The power source voltage supply unit may be configured to receive the control signal, to generate the first power source voltage according to the control signal, and to output the first power source voltage to the pixel.

The power source voltage supply unit may be configured to generate a second power source voltage and to supply the second power source voltage to the pixel, wherein a current corresponding to a voltage of the data signal and the second power source voltage may flow to the pixel.

The measured luminance value may be compared with the target luminance value, and the first power source voltage value may be increased to a maximum voltage value within a voltage range where the measured luminance value coincides with the target luminance value.

The first power source voltage value may be changed from a maximum voltage value of a voltage range corresponding to a saturation region of a driving current of the pixel to a voltage value having a voltage difference of a driving voltage margin of the pixel from the maximum voltage value.

The control signal may sequentially raise the first power source voltage value within a voltage range corresponding to a saturation region of a driving current of the pixel.

The measured luminance value of the pixel that emits light corresponding to a driving current corresponding to an initial data signal may be compared with the target luminance value, and when the measured luminance value does not coincide with the target luminance value, the voltage value of the data signal corresponding to the target luminance value may be determined by correcting a voltage value of the initial data signal.

The test device for a display panel may also include a data driver configured to supply the determined voltage value of the data signal to each of the plurality of pixels of the display panel.

The data driver may include a data storage unit configured to store information including the target luminance value according to an initial data signal, reference voltage data corrected according to the data signal, and a voltage value of a corresponding data signal determined by correction.

In a test device of a display panel according to an exemplary embodiment of the present invention, a measurement luminance value of a pixel that emits light according to a driving current corresponding to an initial data signal may be compared with the target luminance value, and when the measurement luminance value does not coincide with the target luminance value, the voltage value of the data signal corresponding to the target luminance may be determined by correcting a voltage value of the initial data signal.

Another embodiment of the present invention provides a method of testing a display panel, the method including changing a first power source voltage value applied to a pixel within a voltage range, comparing a target luminance value and a measured luminance value of the pixel that emits light to correspond to the changed first power source voltage value, determining an immediately previous first power source voltage value when the measured luminance value does not coincide with the target luminance value, and setting the immediately previous first power source voltage value as an output first power source voltage value.

The changing the first power source voltage value may include adjusting the first power source voltage value of the pixel while sequentially raising the first power source voltage value within a voltage range.

The voltage range may correspond to a saturation region of a driving current of the pixel.

The output first power source voltage value may be a maximum voltage value of the voltage range where the measured luminance value coincides with the target luminance value.

The output first power source voltage value may be a maximum voltage value of the voltage range corresponding to a saturation region of a driving current of the pixel.

The method of testing a display panel may further include determining a final output first power source voltage value to be a voltage value that is the output first power source voltage value reduced by a driving voltage margin of the pixel after the determining of the immediately previous first power source voltage value, and setting the immediately previous first power source voltage value as the output first power source voltage value.

The method of testing a display panel may further include determining a voltage value of a data signal corresponding to the target luminance value before changing the first power source voltage value.

The measured luminance value may be determined by measuring a luminance value of the pixel, and determining the voltage value of the data signal corresponding to the target luminance value may include emitting light from the pixel by supplying an initial data signal and determining the measured luminance value of the pixel, and comparing the measured luminance value and the target luminance value and correcting a voltage value of the data signal and determining a voltage value of the initial data signal when the measured luminance value does not coincide with the target luminance value.

In order to apply a method of testing the display panel according to an exemplary embodiment of the present invention to the display device, a luminance measurement unit that is coupled to each of the plurality of pixels to measure a luminance value may be provided. Further, the signal controller may further include a controller that determines a voltage value of a data signal corresponding to a target luminance (e.g., a predetermined target luminance) and that is coupled to the luminance measurement unit to receive a measurement luminance value of a pixel in which the determined data signal is supplied from the luminance measurement unit and that compares the measurement luminance value with the target luminance value and that outputs a control signal changing the first power source voltage value that is supplied from the power source voltage supply unit to the pixel until the measurement luminance value does not coincide with the target luminance value.

In this case, when a measured luminance value of a pixel that emits light according to a voltage value of a corresponding initial data signal supplied to each pixel does not coincide with a target luminance value, the signal controller may correct the voltage value of the initial data signal and thus determine a voltage value of a data signal corresponding to the target luminance, and supply the voltage value of the determined data signal to a data driver.

According to one embodiment of the present invention, there is provided a test device for a display panel of a high image quality in which a stain defect of a screen is removed or prevented according to internal and external environment changes of the display panel while reducing power consumption by controlling a driving power source of the display panel.

Further, according to one embodiment of the present invention, there is provided a method in which a display panel embodies highest image quality with appropriate power consumption through a method of testing and controlling a voltage and image quality of a driving power source of the display panel.

BRIEF DESCRIPTION OF THE DRAWINGS

The accompanying drawings, together with the specification, illustrate exemplary embodiments of the present invention, and, together with the description, serve to explain the principles of embodiments of the present invention.

DETAILED DESCRIPTION

Figure 1:
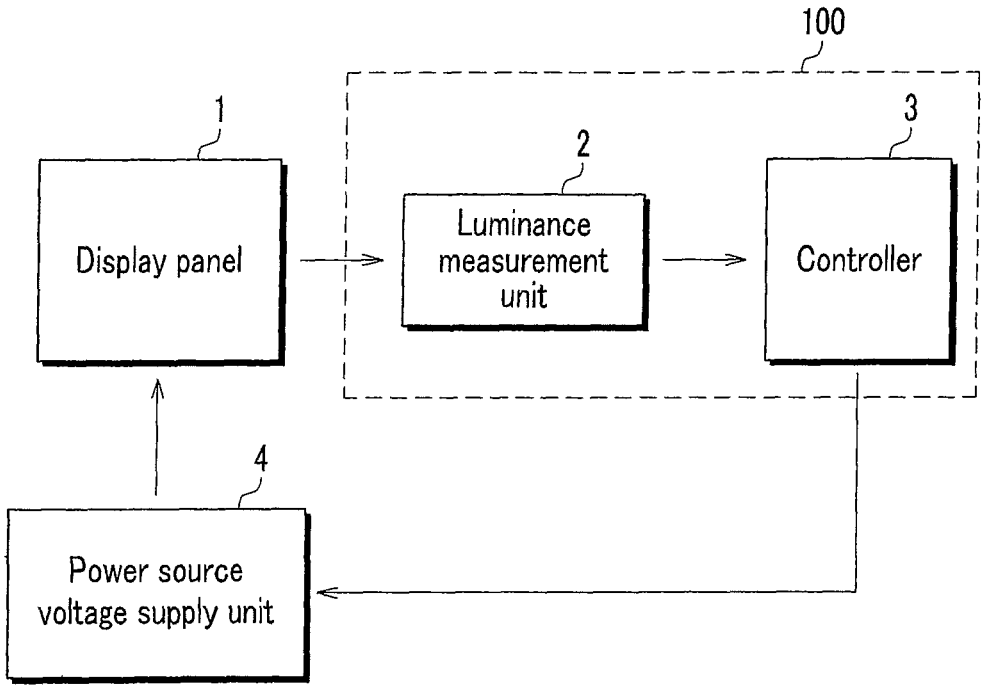
FIG. 1 is a block diagram illustrating a test device according to one exemplary embodiment of the present invention.

Certain exemplary embodiments according to the present invention will be described more fully hereinafter with reference to the accompanying drawings. As those skilled in the art would realize, the described embodiments may be modified in various different ways without departing from the spirit or scope of the present invention.

Further, like reference numerals designate like elements in several exemplary embodiments that are representatively described in reference to the first exemplary embodiment, and elements different from those of the first exemplary embodiment will be described in other exemplary embodiments.

The drawings and description are to be regarded as illustrative in nature and not restrictive. Like reference numerals designate like elements throughout the specification.

Throughout this specification and the claims that follow, when it is described that an element is "coupled" to another element, the element may be "directly coupled" to the other element or "electrically coupled" to the other element via one or more other elements. In addition, unless explicitly described to the contrary, the word "comprise" and its variations, such as "comprises" or "comprising," will be understood to imply the inclusion of stated elements but not the exclusion of any other elements.

FIG. 1 is a block diagram illustrating a test device according to an exemplary embodiment of the present invention.

Referring to FIG. 1, a test device 100 according to an exemplary embodiment of the present invention includes a luminance measurement unit 2 coupled to a display panel 1, and a controller 3 coupled to the luminance measurement unit 2.

When the display panel 1 including a plurality of pixels emits light corresponding to an image data signal, the luminance measurement unit 2 measures a luminance value of the display panel 1.

The controller 3 is coupled to a power source voltage supply unit 4 that supplies a power source voltage to the display panel 1.

The controller 3 receives a pixel luminance value (e.g., a measured luminance value) of the display panel 1 measured by the luminance measurement unit 2. The display panel 1 displays an image that emits light according to a supplied corresponding data signal, and according to the described embodiment, an appropriate target luminance value (e.g., a predetermined target luminance value) is already set.

The controller 3 compares the measured luminance value (e.g., a received present luminance value) of the pixel and the target luminance value. In this case, the controller 3 outputs a control signal that changes a first power source voltage value of the power source voltage supply unit 4 until the measured luminance value and the target luminance value do not coincide with each other.

The target luminance value may be a specified value, or may be a target luminance value in consideration of a margin (e.g., a range of values corresponding to the target luminance value). That is, a user can change the first power source voltage value within a range that would not result in exceeding the limit of luminance range within the margin, which would be recognized as the target luminance value.

For example, when the target luminance value is 100, when a luminance margin of a level that can be recognized as 100 is 2, a control signal that changes the first power source voltage value is generated and supplied at the limit in which the measured luminance value of a pixel is within a range of the target luminance value of 100 to 102.

The measured luminance value and the target luminance value are compared, and as long as the measured luminance value and the target luminance value coincide, unnecessary power consumption can be reduced or prevented by changing the first power source voltage value to be as high as possible and operating the display panel at the maximum possible first power source voltage value.

The test device 100 of the display panel 1 according to an exemplary embodiment of the present invention outputs a control signal that changes a first power source voltage value of the power source voltage supply unit 4 in order to apply a power source voltage in which power consumption of the display panel 1 can be reduced to the minimum within a range in which the measured luminance value coincides with the target luminance value.

In order to change the first power source voltage value within a range in which the measured luminance value coincides with the target luminance value, the luminance measurement unit 2 repeats a process of determining (e.g., measuring) the measured luminance value (e.g., a received present luminance value) of the display panel 1, receiving information of the measured luminance value, and comparing the measured luminance value with the target luminance value.

The first power source voltage value can be sequentially changed. For example, the first power source voltage value may be changed while being sequentially raised within a voltage range corresponding to a saturation region of a driving transistor that is included in the pixel.

In general, in the display device, an amount of light emitted by a pixel is proportional to a driving current flowing to a light emitting element of the pixel. Further, as a driving power source voltage that is applied across ends of the light emitting element increases, the driving current increases in proportion to the increased driving power source voltage. The driving current does not always have a linear relationship to the voltage, but above a certain level, even if a driving power source voltage increases, the driving current no longer increases, and thus, there exists a saturation region in which the light emitted by the pixel does not increase.

A driving transistor of the pixel should be driven in a saturation region of such a driving current, and in order for a pixel to emit light (e.g., to emit light to an optimum level), light should be emitted with a driving power source voltage at a starting point of the saturation region. When increasing the driving power source voltage (e.g., beyond the starting point of the saturation region), excessive power is unnecessarily consumed. When light is emitted with a driving power source voltage at a point that escapes the saturation region by reducing the driving power source voltage, light is not emitted with a target luminance, and thus, the display panel may fail (e.g., produce a low quality image).

Figure 2:
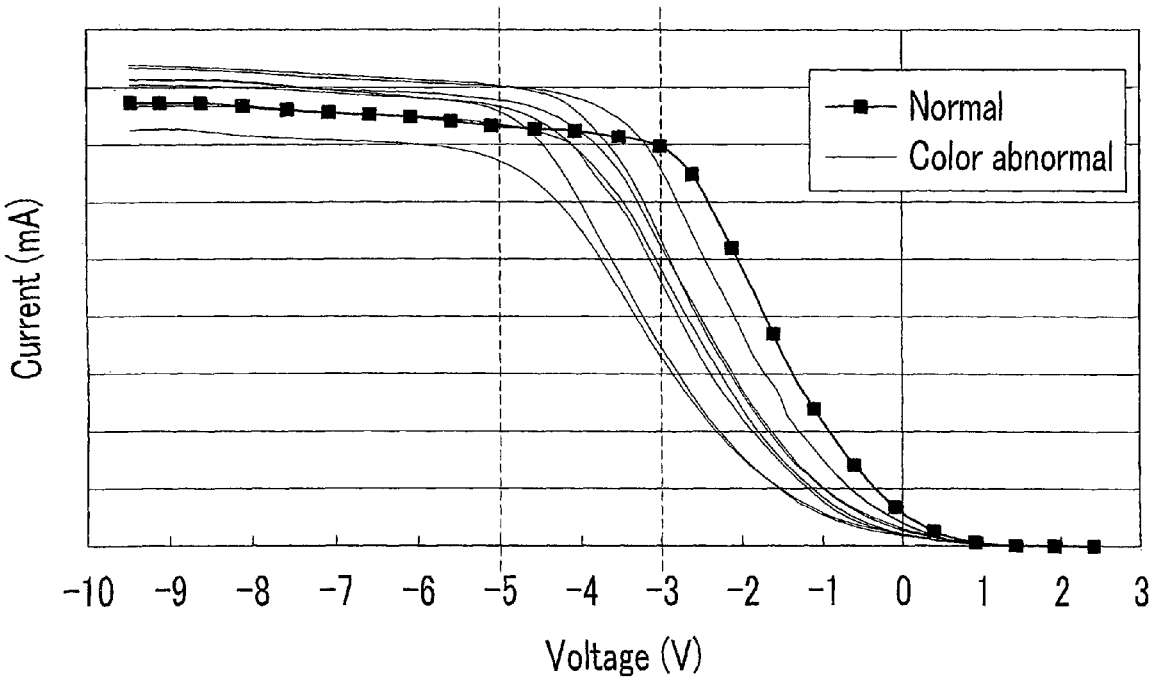
FIG. 2 is an example of a graph illustrating scattering of a driving margin of a driving voltage ELVSS of a display panel in existing technology.

For example, the graph of FIG. 2 illustrates such a problem. FIG. 2 is a graph illustrating scattering of a driving margin of a driving voltage of a display panel.

FIG. 2 illustrates various distributions of a driving voltage on a pixel-by-pixel basis. In general, a characteristic curve of current (e.g., driving current) vs. driving voltage of each pixel generally has linearity, but reaches a saturation region in which the driving current does not increase even if the driving voltage increases.

FIG. 2 shows that a range of the driving voltage value in which the saturation region starts on a pixel-by-pixel basis is variously distributed between −3V and −5V. Therefore, by collectively applying a driving power source voltage of −6V or more to an existing driving power source voltage value, unnecessary excessive power consumption for pixels having a saturation region starting point of about −3V is caused.

Therefore, by outputting a control signal that sequentially raises the first power source voltage value within a voltage range corresponding to the saturation region, a first power source voltage value corresponding to the saturation region starting point can be found and is determined as an output first power source voltage value.

At this time, in consideration of a driving voltage margin for compensating for a driving voltage variation between the pixels because of scattering caused by manufacturing process, a final output first power source voltage value can be determined.

When the controller 3 outputs a control signal that supplies a voltage value that exceeds the voltage range corresponding to the saturation region as the first power source voltage value, a driving current that emits light from the corresponding pixel decreases, and thus, color abnormality might occur because of the reduction of light emitted by the pixel.

Therefore, a first power source voltage value immediately preceding escaping the voltage range corresponding to the saturation region can be determined as the output first power source voltage value of the display panel 1.

The power source voltage supply unit 4 that supplies the power source voltage that drives the display panel 1 generates and supplies a first power source voltage ELVSS and a second power source voltage ELVDD. A pixel that is included in the display panel emits light by a driving current according to a voltage of a corresponding data signal and a voltage difference between the first power source voltage ELVSS and the second power source voltage ELVDD. The second power source voltage ELVDD may be a fixed voltage of a high level, and the first power source voltage ELVSS may be an adjustable voltage of a low level.

Therefore, the controller 3 generates a control signal that changes the first power source voltage ELVSS and supplies the control signal to the power source voltage supply unit 4 while the target luminance value coincides with the measured luminance value in order to reduce power consumption while the display panel 1 emits light with luminance corresponding to the target luminance value.

The power source voltage supply unit 4 supplies and slowly increases the first power source voltage ELVSS according to the control of the controller 3, and when the measured luminance value of a display panel that emits light corresponding to the increased power source voltage does not coincide with the target luminance value, the controller 3 again supplies a control signal to the power source voltage supply unit 4, causing the power source voltage supply unit 4 to output an immediately previous first power source voltage value and stores the immediately previous first power source voltage value.

According to an exemplary embodiment of the present invention, even when the first power source voltage value is determined, a driving margin voltage that compensates for a driving voltage difference of each pixel due to process scattering of the display panel 1 can be considered. That is, after the first power source voltage value is determined, the first power source voltage value can be finally determined as a voltage value that is reduced by a driving voltage margin of a driving transistor and an organic light emitting element due to process scattering.

In this case, power consumption of each pixel that is calculated with multiplication of a difference voltage between the first power source voltage value and the second power source voltage that are applied across ends of the OLED, and a driving current can somewhat increase due to the first power source voltage value that is reduced by the driving voltage margin, but contributes to stable display panel operation.

Figure 3:
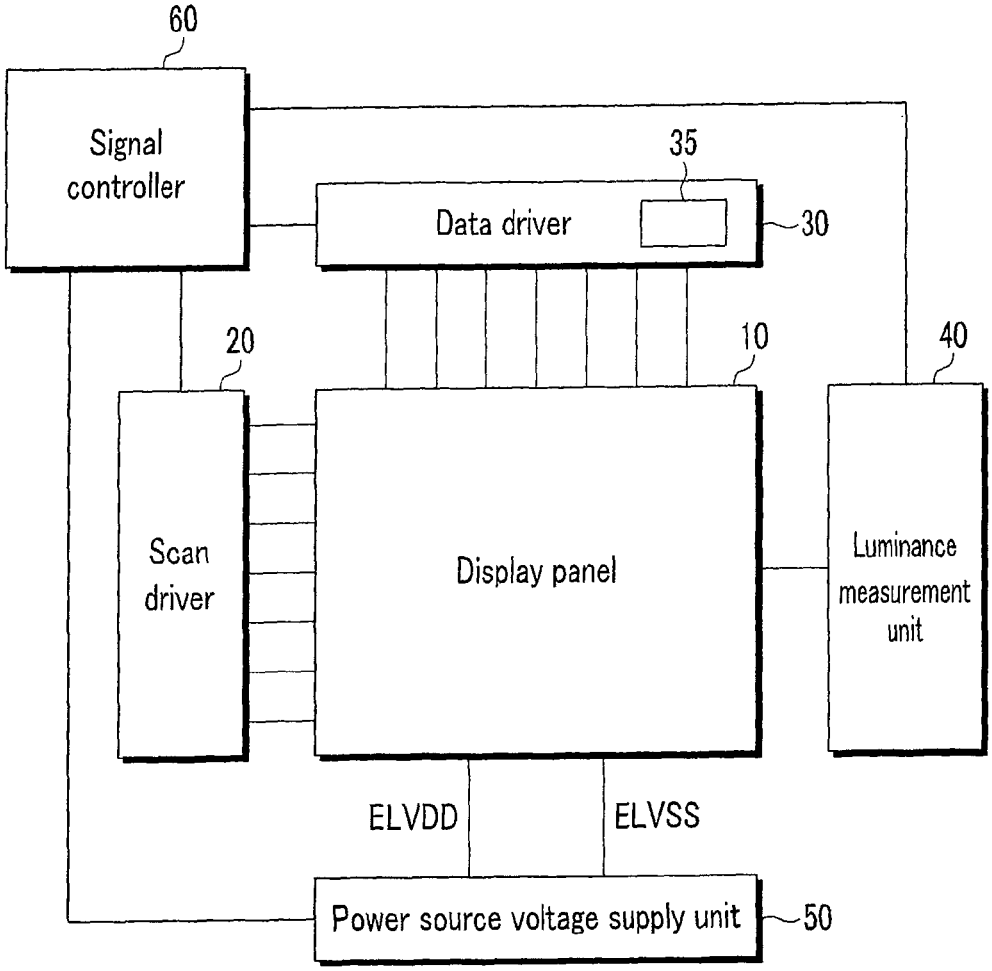
FIG. 3 is a block diagram illustrating an example in which a test device according to one exemplary embodiment of the present invention is applied to a display panel.

FIG. 3 is a block diagram illustrating a test device applied to a display panel according to an exemplary embodiment of the present invention.

The test device of the described embodiment can be used for testing a display panel by applying it to a display device including the display panel.

Figure 4:
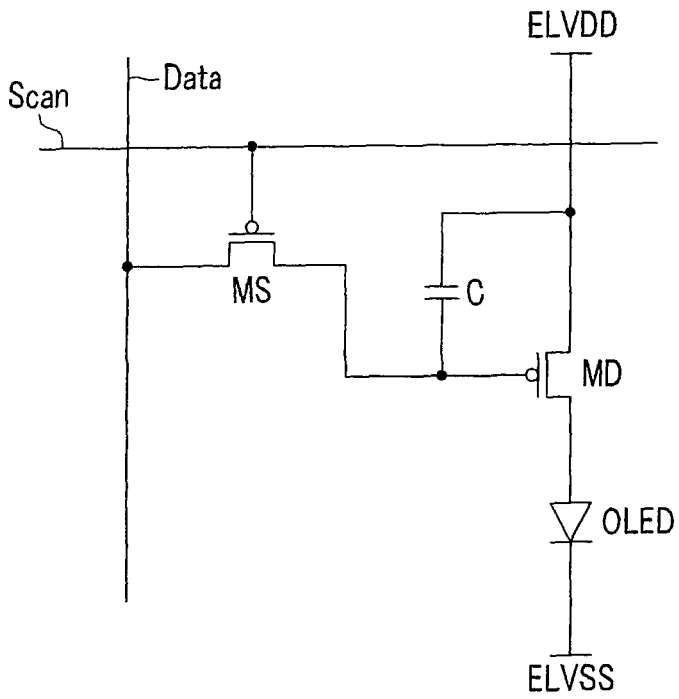
FIG. 4 is a circuit diagram illustrating a pixel of the display panel of embodiments according to the present invention shown in FIG. 3.

Referring to FIG. 3, a display device to which the test device of one embodiment is applied includes a display panel 10 including a plurality of pixels (e.g., a circuit diagram of one pixel of the plurality of pixels is shown in FIG. 4), a scan driver 20 that supplies a plurality of scan signals to the plurality of pixels of the display panel 10, a data driver 30 that supplies a plurality of data signals corresponding to the plurality of pixels of the display panel 10, a luminance measurement unit 40 that is coupled to the display panel 10 to measure luminance of an image displayed on the display panel 10, a power source voltage supply unit 50 that applies the first power source voltage ELVSS and the second power source voltage ELVDD to the plurality of pixels of the display panel 10, and a signal controller 60 that is coupled to the scan driver 20, the data driver 30, and the power source voltage supply unit 50 to control driving of the plurality of scan signals and the plurality of data signals.

The signal controller 60 determines a voltage value of a data signal corresponding to a target luminance value (e.g., a predetermined target luminance value), receives a measured luminance value of a pixel that is coupled to the luminance measurement unit 40 to receive the determined data signal (e.g., the determined voltage value of the data signal) from the luminance measurement unit 40, compares the measured luminance value with the target luminance value, and outputs a control signal that changes the first power source voltage value supplied from the power source voltage supply unit 50 to the pixel while the measured luminance value coincides with the target luminance value.

The signal controller 60 is coupled to the data driver 30 and the luminance measurement unit 40 to determine the voltage value of the data signal corresponding to the target luminance value.

That is, the data driver 30 supplies a voltage value of an initial data signal corresponding to each of the plurality of pixels of the display panel 10, the luminance measurement unit 40 measures a luminance value of a pixel that emits light with a driving current according to the voltage value of the initial data signal and provides the measured luminance value to the signal controller 60, and thus, the signal controller 60 compares the measured luminance value and the target luminance value.

Thereafter, if the measured luminance value does not coincide with the target luminance value, the voltage value of the initial data signal can be corrected and determined as a voltage value of a data signal corresponding to the target luminance value, and the determined voltage value of the data signal can be supplied to the data driver 30.

After a voltage value of an appropriate data signal corresponding to target luminance is newly fixed and set through correction, as described above, the first power source voltage value outputted by the power source voltage supply unit 50 can be determined using a test device of the display panel 10 according to an exemplary embodiment of the present invention.

In this case, the data driver 30 may further include a data storage unit 35 to store information including the target luminance value according to the initial data signal, reference voltage data corrected according to a data signal, and a voltage value of a corresponding data signal that is determined by correction.

FIG. 4 is a circuit diagram illustrating an exemplary embodiment of a pixel of the display panel that is shown in FIG. 3.

FIG. 4 illustrates a circuit diagram of a pixel of a display panel of a display device, and includes an OLED that is coupled between the first power source voltage ELVSS and the second power source voltage ELVDD, a driving transistor MD that is coupled to an anode of the OLED, a switching transistor MS that is coupled to a gate electrode of the driving transistor MD, and a capacitor C that is coupled between the gate electrode of the driving transistor MD and the second power source voltage ELVDD.

The OLED includes an anode and a cathode, and emits light by a driving current according to a corresponding data signal.

The driving transistor MD supplies the driving current to the OLED according to the corresponding data signal.

The switching transistor MS includes a source electrode that is coupled to a data line Data to supply a data signal, a drain electrode that is coupled to a gate electrode of the driving transistor MD, and a gate electrode that is coupled to a scan line Scan to receive a scan signal, and supplies a voltage value of the data signal corresponding to a pixel to the gate electrode of the driving transistor MD of the pixel in response to the scan signal.

The capacitor C includes a first electrode that is coupled to the source electrode of the driving transistor MD and a second electrode that is coupled to the gate electrode of the driving transistor MD, and sustains a gate electrode voltage and a source electrode voltage of the driving transistor MD (e.g., a voltage across the gate electrode and the source electrode of the driving transistor MD). The switching transistor MS is turned on according to the scan signal, and when a data signal voltage according to the corresponding data signal is supplied to a contact point at which the second electrode of the capacitor C and the gate electrode of the driving transistor MD meet, a voltage value (e.g., VG in the equation below) of the contact point becomes a voltage value in which a data signal voltage value is applied to the voltage that is lower than the second power source voltage ELVDD by the threshold voltage of the driving transistor MD, as can be seen in the following equation.

$$VG=ELVDD+\Delta V+Vth \quad \text{Equation}$$

In this case, because the driving transistor is a PMOS transistor, a threshold voltage Vth of the equation has a negative value. A voltage value VG corresponds to a previously described data signal, and the capacitor C sustains a difference between this voltage value VG and the second power source voltage ELVDD until a next data signal is newly written.

That is, when a data signal is supplied, a voltage that is applied to the gate electrode of the driving transistor MD is changed by a voltage corresponding to a data signal (e.g., represented by ΔV in the Equation). This voltage is supplied to the gate electrode of the driving transistor MD, and a voltage difference between the gate electrode and the source electrode of the driving transistor MD is constantly sustained by the capacitor C.

Regarding the test device of a display panel according to an exemplary embodiment of the present invention, in order to determine the first power source voltage ELVSS that is applied to each pixel of the display panel, when emitting light from each pixel, a luminance value is measured, and while the measured luminance value coincides with the target luminance, the first power source voltage value is changed and a corresponding luminance reaction is checked, and then the first power source voltage value corresponding to the measurement that is immediately previous to when the luminance value does not coincide with the target luminance is fixed and set as a first power source voltage value in which power consumption is desirably reduced (e.g., optimally reduced).

In the equation, a driving current flowing according to the corresponding data signal in the OLED corresponds to a voltage difference between a voltage value VG of a contact point at which the second electrode of the capacitor C and the gate electrode of the driving transistor MD meet and the second power source voltage ELVDD, and while the first power source voltage ELVSS coincides with the target luminance, when a voltage value that is raised to the maximum is searched for and set to the first power source voltage ELVSS of the display panel, driving power consumption of each pixel can be reduced (e.g., optimally reduced).

That is, driving power consumption of each pixel is determined by multiplication of a current flowing to the OLED of the pixel and a voltage across ends of the OLED (e.g., current through the OLED multiplied by the voltage across the OLED). In a state where the second power source voltage ELVDD is fixed, when the first power source voltage ELVSS is very low, a voltage difference between the ends of the OLED (e.g., a voltage across the OLED) increases and thus even when the same current flows, driving power consumption increases. Therefore, when applying a test device and a method of testing a display panel according to exemplary embodiments of the present invention, the driving transistor of the pixel can be operated in the saturation region and a voltage value of the first power source voltage ELVSS that makes a voltage difference between ends of the OLED the minimum can be selected and determined.

Figure 5:
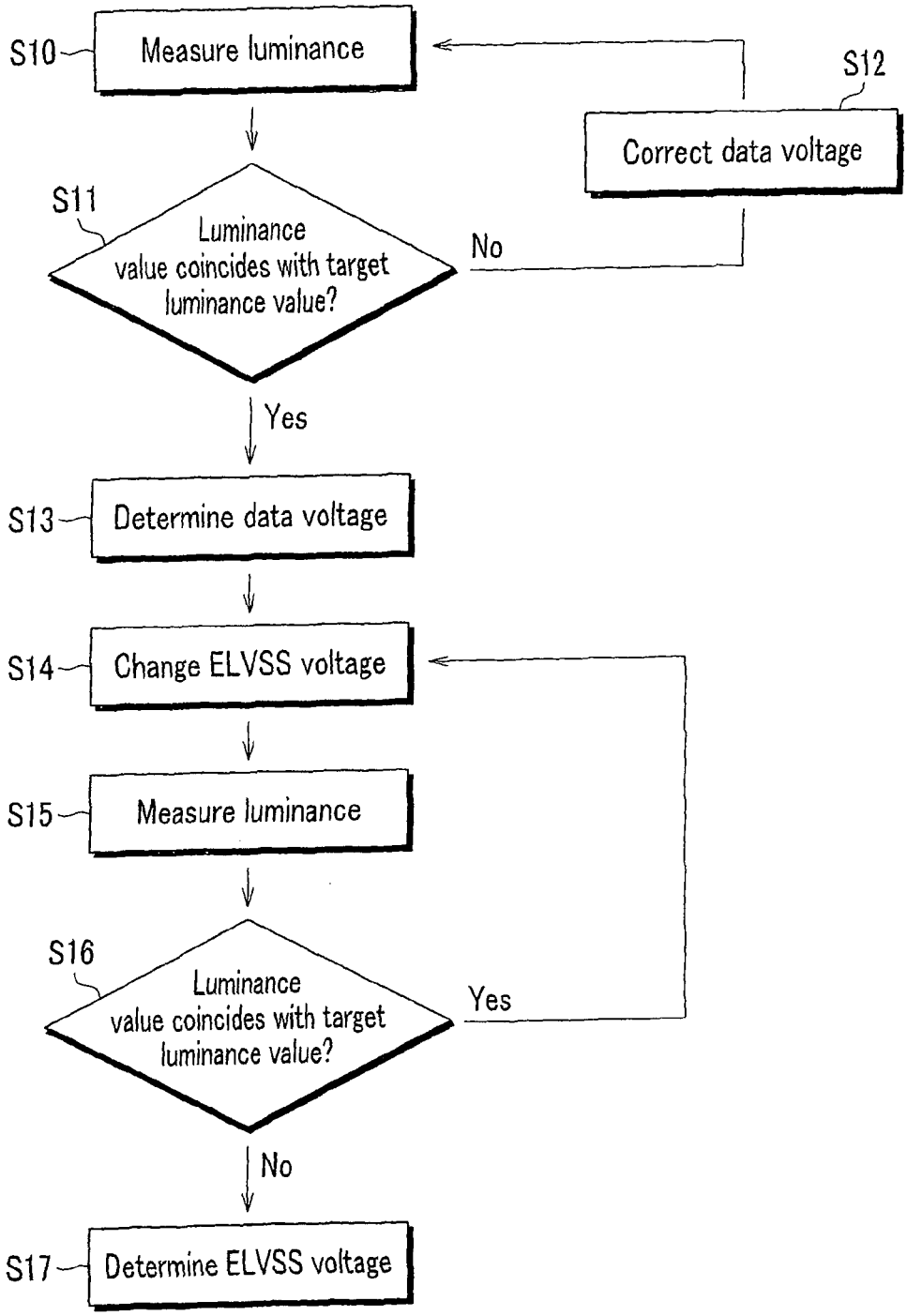
FIG. 5 is a flow diagram illustrating a method of testing a display panel according to one exemplary embodiment of the present invention.

FIG. 5 is a flow diagram illustrating a method of testing a display panel according to an exemplary embodiment of the present invention.

For example, FIG. 5 is a flow diagram including steps of determining a voltage value of a data signal corresponding to target luminance in a method of testing a display panel according to an exemplary embodiment of the present invention.

Accordingly, when a voltage value of a data signal corresponding to target luminance is already determined, steps S10 to S13 of FIG. 5 may be omitted.

Referring to FIG. 5, a method of testing a display panel according to an exemplary embodiment of the present invention includes a step of measuring light emitted by a pixel of a display panel corresponding to an initial data signal in order to determine a voltage value of a data signal corresponding to the target luminance (S10).

A next step is determining whether the measured luminance value corresponds to a target luminance value of the data signal (S11).

For example, it is determined whether or not the measured luminance value coincides with the target luminance value, and in some cases, it may be determined whether or not the measured luminance value coincides with the target luminance value to which a margin is added (e.g., a range of values corresponding to the target luminance).

When the measured luminance value does not coincide with a target luminance value, a data voltage is corrected (S12) (e.g., when the measured luminance value is below the target luminance value, the data voltage is decreased).

A method of correcting a data voltage is not particularly limited, and a well-known data correction method that corrects a voltage value of a data signal based on reference voltage correction data can be used.

When the measured luminance value coincides with the target luminance value, the data voltage is not corrected (e.g., not adjusted) and a voltage value of a corresponding data signal is determined as a voltage value of a data signal corresponding to the target luminance (S13).

In this way, when the voltage value of the data signal is set, the first power source voltage value that is supplied to a pixel is changed within a voltage range (e.g., a predetermined voltage range) (S14).

As described above, a control signal that changes the first power source voltage value while sequentially raising it within a voltage range is generated in the controller, is output to the power source voltage supply unit, and is supplied to the pixel as the first power source voltage value that is changed in the power source voltage supply unit receiving the control signal.

Next, the changed first power source voltage is received and a luminance value of a driven pixel is measured (S15).

Next, it is determined whether a luminance value measured at step S15 coincides with the target luminance value (S16). In some cases, it may be determined whether the measured luminance value coincides with a range that can be recognized as a target luminance, e.g., a target luminance value to which a margin is added.

If the luminance value measured at step S15 coincides with the target luminance value, or if the luminance value measured at step S15 is the luminance value within the range of the target luminance value to which the margin is added, the step in which the controller generates and supplies a control signal that changes the first power source voltage value (e.g., S14), and the aforementioned subsequent steps (e.g., S15 and S16), are repeated.

That is, in this case, even if the display panel is driven with the first power source voltage value that is changed by the control signal for changing the first power source voltage value, as the display panel displays images with a target luminance, a voltage value (e.g., an optimum voltage value) that reduces power consumption can be searched again by changing the first power source voltage value.

If the luminance value measured at step S15 does not coincide with the target luminance value, the first power source voltage value is determined without further adjustment to the first power source voltage value (S17).

When the luminance value measured at step S15 does not coincide with the target luminance value, the first power source voltage value is determined as an immediately previous first power source voltage value. In some cases, the first power source voltage value may be determined as a voltage value that is reduced by a driving margin voltage value in consideration of a driving margin of pixels due to process scattering.

Figure 6:
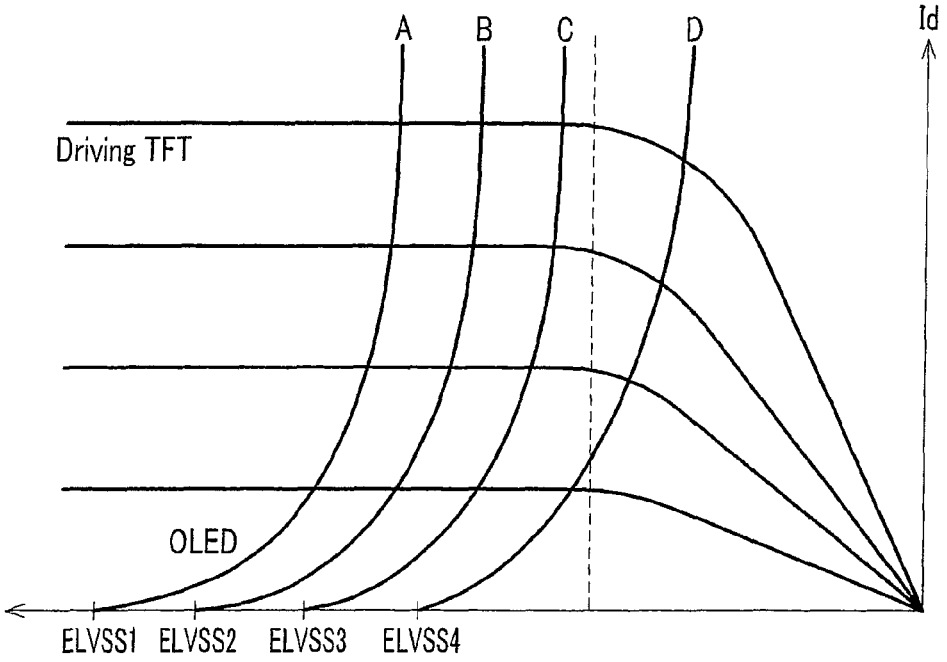
FIG. 6 is an example of a characteristic curve graph illustrating current vs. a power source voltage in which different voltage values are input to a pixel of the display panel of the embodiment according to the present invention shown in FIG. 4.

FIG. 6 is an example of a characteristic curve graph illustrating a relationship between a driving current of a pixel and a change of a first power source voltage ELVSS that is input to the pixel of the display panel that is shown in FIG. 4.

Referring to FIG. 6, a graph (e.g., a characteristic curve graph) for a driving current of a driving TFT having a saturation region in which a driving current lineally increases for a given range but no longer increases in a voltage range of a region (e.g., a predetermined region) or beyond.

Accordingly, a characteristic curve of the OLED changes a voltage value of the applied first power source voltage ELVSS, and thus meets with a characteristic curve of a driving transistor while forming different characteristic curves as A, B, C, and D.

In a test device and a method of testing a display panel according to exemplary embodiments of the present invention, while the voltage value of the first power source voltage ELVSS is changed from ELVSS1 through to ELVSS4, a voltage value (e.g., an optimum voltage value) that can reduce power consumption (e.g., to the minimum) and that can sustain screen display quality, such as luminance of the display panel, is selected, as shown in the graph of FIG. 6.

In the graph of FIG. 6, the left side of a portion that is indicated by a dotted line (e.g., the area to the left of the dotted line) is a saturation region of the driving transistor, and the driving should be performed in a range of at least the saturation region in the display panel (e.g., in the range to the left of the dotted line), and when the driving is performed in another current range (e.g., not a saturation region due to scattering of the driving transistor and scattering of the OLED), a screen failure such as a stain defect and luminance deterioration may occur.

Referring to FIG. 6, the test device according to an exemplary embodiment of the present invention changes the first power source voltage value from ELVSS1 to ELVSS4, measures luminance of the driven display panel, and determines an optimum voltage value. In the graph of FIG. 6, the display panel that is driven with the first power source voltage value of ELVSS4 escapes (e.g., exceeds) a saturation region while forming a D-type curved line and thus an immediately previous first power source voltage value of ELVSS3 can be determined as a voltage value (e.g., an optimum voltage value) in which luminance is sustained while reducing power consumption.

DESCRIPTION OF SOME OF THE REFERENCE NUMERALS

| | |
|---|---|
| 1, 10: display panel | 2, 40: luminance measurement unit |
| 3: controller | 4, 50: power source voltage supply unit |
| 20: scan driver | 30: data driver |
| 35: data storage unit | 60: signal controller |
| 100: test device | |

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims, and their equivalents.

What is claimed is:

1. A test device for a display panel, comprising:

a luminance measurement unit configured to measure a luminance value of the display panel comprising a plurality of pixels; and a controller configured to determine a voltage value of a data signal corresponding to a target luminance value, to receive a measured luminance value of a pixel to which the data signal is supplied from the luminance measurement unit from among the plurality of pixels, configured to compare the measured luminance value and the target luminance value, to correct the voltage value of the data signal until the measured luminance value coincides with the target luminance value, configured to output a control signal, after the measured luminance value coincides with the target luminance value, that changes a first power source voltage value supplied from a power source voltage supply unit to the pixel until the measured luminance value does not coincide with the target luminance value, and configured to set, as an output first power source voltage value, the first power source voltage value used immediately before the controller determines the measured luminance value does not coincide with the target luminance value.

2. The test device of claim 1, wherein the power source voltage supply unit is configured to receive the control signal, to generate the first power source voltage according to the control signal, and to output the first power source voltage to the pixel.

3. The test device of claim 2, wherein the power source voltage supply unit is configured to generate a second power source voltage and to supply the second power source voltage to the pixel, wherein a current corresponding to a voltage of the data signal and the second power source voltage flows to the pixel.

4. The test device of claim 1, wherein the measured luminance value is compared with the target luminance value, and the first power source voltage value is increased to a maximum voltage value within a voltage range where the measured luminance value coincides with the target luminance value.

5. The test device of claim 1, wherein the first power source voltage value is changed from a maximum voltage value of a voltage range corresponding to a saturation region of a driving current of the pixel to a voltage value having a voltage difference of a driving voltage margin of the pixel from the maximum voltage value.

6. The test device of claim 1, wherein the control signal sequentially raises the first power source voltage value within a voltage range corresponding to a saturation region of a driving current of the pixel.

7. The test device of claim 1, wherein the measured luminance value of the pixel that emits light corresponding to a driving current corresponding to an initial data signal is compared with the target luminance value, and when the measured luminance value does not coincide with the target luminance value, the voltage value of the data signal corresponding to the target luminance value is determined by correcting a voltage value of the initial data signal.

8. The test device of claim 1, further comprising a data driver configured to supply the determined voltage value of the data signal to each of the plurality of pixels of the display panel.

9. The test device of claim 8, wherein the data driver comprises a data storage unit configured to store information including the target luminance value according to an initial data signal, reference voltage data corrected according to the data signal, and a voltage value of a corresponding data signal determined by correction.

10. A method of testing a display panel, the method comprising:

measuring a luminance value of a pixel receiving a data signal;

comparing the measured luminance value to a target luminance value;

correcting a voltage value of the data signal and again measuring the luminance value until the measured luminance value coincides with the target luminance value;

changing a first power source voltage value applied to the pixel within a voltage range and again measuring the luminance value until the measured luminance value does not coincide with the target luminance value;

determining an immediately previous first power source voltage value when the measured luminance value does not coincide with the target luminance value; and setting the immediately previous first power source voltage value as an output first power source voltage value.

11. The method of claim 10, wherein the changing the first power source voltage value comprises adjusting the first power source voltage value of the pixel while sequentially raising the first power source voltage value within the voltage range.

12. The method of claim 10, wherein the voltage range corresponds to a saturation region of a driving current of the pixel.

13. The method of claim 10, wherein the output first power source voltage value is a maximum voltage value of the voltage range where the measured luminance value coincides with the target luminance value.

14. The method of claim 10, wherein the output first power source voltage value is a maximum voltage value of the voltage range corresponding to a saturation region of a driving current of the pixel.

15. The method of claim 10 further comprising determining a final output first power source voltage value to be a voltage value that is the output first power source voltage value reduced by a driving voltage margin of the pixel after the determining of the immediately previous first power source voltage value, and setting the immediately previous first power source voltage value as the output first power source voltage value.

16. The method of claim 10 further comprising determining the voltage value of the data signal corresponding to the target luminance value before changing the first power source voltage value.

17. The method of claim 16, further comprising determining the voltage value of the data signal corresponding to the target luminance value by:

emitting light from the pixel by supplying an initial data signal and determining the measured luminance value of the pixel; and comparing the measured luminance value and the target luminance value and correcting the voltage value of the data signal and determining a voltage value of the initial data signal when the measured luminance value does not coincide with the target luminance value.

* * * * *